US005180009A

United States Patent [19]

Sneed

[11] Patent Number: 5,180,009

[45] Date of Patent: Jan. 19, 1993

[54] WIRELINE DELIVERY TOOL

[76] Inventor: William Sneed, P.O. Box 1, Cleveland, Okla. 74020

[21] Appl. No.: 783,175

[22] Filed: Oct. 28, 1991

[51] Int. Cl.[5] ..... E21B 23/10

[52] U.S. Cl. ..... 166/155; 166/50; 166/325; 166/383

[58] Field of Search ..... 166/155, 156, 153, 50, 166/383, 325

[56] References Cited

U.S. PATENT DOCUMENTS

| | | | |
|---|---|---|---|
| 2,810,442 | 10/1957 | Tausch | 166/156 |
| 3,020,955 | 2/1962 | Tausch | 166/156 X |
| 3,070,167 | 12/1962 | Loy, III et al. | 166/155 |
| 3,090,440 | 5/1963 | Lagucki | 166/155 |
| 3,126,058 | 3/1964 | Yetman | 166/156 X |
| 3,312,282 | 4/1967 | Yetman | 166/383 |
| 3,395,598 | 8/1968 | Talley, Jr. | 166/155 |
| 3,530,935 | 9/1970 | Garrett | 166/153 |
| 3,543,852 | 12/1970 | Taylor | 166/155 |
| 3,727,693 | 4/1973 | Tausch et al. | 166/156 X |
| 3,771,597 | 11/1973 | McGowen, Jr. | 166/156 X |
| 4,019,574 | 4/1977 | Mott | 166/156 X |
| 4,068,712 | 1/1978 | Stump | 166/156 |
| 4,119,147 | 10/1978 | Arendt et al. | 166/155 |
| 4,398,601 | 8/1983 | Schwendemann | 166/156 X |
| 4,729,429 | 3/1988 | Wittrisch | 166/65.1 |

*Primary Examiner*—Hoang C. Dang
*Attorney, Agent, or Firm*—Head & Johnson

[57] ABSTRACT

A wireline delivery tool for an underground well having a pipe, a surface seal for the pipe, and a wireline extending from the surface into the pipe. The wireline delivery tool includes a body having a diameter less than the interior diameter of the pipe and a cup extending from the body to create a seal with the interior of the pipe. A longitudinal bore within at least a portion of the body has a port through the body on each side of the cup, so that the ports are in communication with the interior of the pipe. A pressure valve within the bore is normally in the closed position. Pressure supplied into the pipe between the surface seal and the cup will move the delivery tool within the pipe.

4 Claims, 2 Drawing Sheets

WIRELINE DELIVERY TOOL

BACKGROUND OF THE INVENTION

1. Field of the Invention

The present invention is directed to a device to deliver a wireline tool to the bottom of a well. In particular, the present invention is directed to a device to deliver a wireline tool in a drill pipe or tubing string which is not vertical to the surface.

2. Prior Art

At the present time, a considerable amount of effort is being invested in horizontal drilling of oil and gas wells. Once a prospective drilling area is located, it is believed that horizontal drilling is a more effective way to locate oil and gas than repeated vertical drilling of wells.

During the drilling process, survey tools, logging tools, perforating guns, and other tools are periodically lowered into the drill pipe or tubing string and then removed. This is done at periodic intervals as the drilling progresses. These well tools are utilized for a number of purposes, including obtaining accurate information on the well bore and the formations exposed in the well bore.

It is also important to insert and remove the well tools quickly, since drilling is interrupted by this process. The cost of a drilling rig and personnel may be thousands of dollars, so it is advantageous to quickly insert and remove the drilling tool.

With a standard vertical well, the force of gravity draws the well tool downward in the drill pipe or tubing string. It has been found that when the well bore deviates beyond approximately 65 degrees from vertical with the earth's surface, gravity forces the survey or other tool against the wall of the drill pipe or tubing string and friction prevents its movement through the bore.

The prior art has illustrated using a fluid to pump a piece of equipment down into the well.

Applicant is aware of the following U.S. Pat. Nos.:

| U.S. Pat. Nos. | Patentee |
|---|---|
| 2,810,442 | Tausch |
| 3,020,955 | Tausch |
| 3,126,058 | Yetman et al. |
| 3,727,693 | Tausch et al. |
| 3,771,597 | McGowen, Jr. |
| 4,019,574 | Mott |
| 4,068,712 | Stump |
| 4,398,601 | Schwendemann et al. |

The Stump patent discloses a chemical spotting tool with extending seal cups to seal against fluid pressure. The tool provides a ball valve to allow fluid to pass through the tool, thereby releasing pressure. The tool may be pumped down the tubing by propelling fluid from a pump.

Mott discloses a safety valve on a running tool.

McGowen provides pump down well equipment having locomotives with the equipment having an outside diameter substantially equal to the inside diameter of the tubing.

Yetman et al. discloses a tool that may be pumped through well tubing wherein fluid is pumped down a tubing string to move the tool. Additionally, inlet fluid ports are provided.

Schwendemann et al. discloses a parking tool that may be pumped down into a well.

The Tausch patents (U.S. Pat. No. 2,810,442 and U.S. Pat. No. 3,727,693) disclose flexible tubular members that may be moved through tubing by attaching to a wireline and pumping or flowing fluid even when the tubing is not vertical.

Tausch (U.S. Pat. No. 3,020,955) provides a pair of a parallel tubing strings wherein a tubular extension member is pumped down or out of the string.

Nothing in the prior art discloses or suggests an apparatus to be used between a wireline and a well tool to deliver the well tool to the proper location in the drill pipe or tubing string.

Accordingly, it is a principal object and purpose of the present invention to provide an apparatus to deliver a well tool to the proper location in the well even if the well bore is not vertical to the surface.

It is a further object and purpose of the present invention to provide an apparatus to deliver a well tool to the proper location in a well bore in an expeditious manner.

SUMMARY OF THE INVENTION

The present invention is directed to a wireline delivery tool to be used with an underground well bore having pipe that extends from the surface of the earth. A drill pipe or tubing string having a diameter less than well bore or casing will extend the length of the well. At the surface, a well head will include equipment to create a seal around the open end of the drill pipe or tubing string.

The wireline delivery device is substantially cylindrical with a diameter that is less than the interior diameter of the drill pipe or tubing string.

The wireline delivery device comprises a series of sections connected end-to-end. A tail section of the device terminates in a threaded end. The tail section contains an inlet port which is in communication with an internal bore extending longitudinally therefrom into the tail section. The bore continues through the tail section and communicates with a similar bore in a cup section. The bore passes longitudinally through the entire length of the cup section.

The cup section, in turn, is threadably connected to a pressure valve section. A portion of the pressure valve section has an internal bore which communicates with the internal bore of the cup section. The valve section contains an outlet port so that the internal bore communicates with the exterior of the device. A passageway is thus formed from the inlet port through the internal bore of the device to the outlet port.

The valve section terminates in an externally threaded end which would be connected to a tool connection section. The tool connection section would receive a well tool such as a survey tool or the like.

At least one cup extends radially from the external surface of the cup section. The external edge of the cup or cups will mate with the interior of the casing to provide a fluid seal therewith. A closed area is thus created between the surface seal and the cup of the device. Pressurized gas or other gaseous medium may be pumped down into the drill pipe or tubing string. The pressure of the gas within the drill pipe or tubing string will force the wireline delivery tool through the drill pipe or tubing string.

A mechanism for pressure release is also provided within the internal bore. A ball will rest in a seat having a passageway therethrough. The ball will be urged against the seat by a spring.

When the pump pressurizes the drill pipe or tubing string, the inlet port will allow pressurized gas to enter the bore so that the pressurized gas will enter the seat and exert a force on the ball. The force of the spring will keep the ball against the seat in the normal operating position. The pressurized gas will overcome gravity and friction and move the cup in relation to the well and thus move the device.

When the device has reached the end of the drill pipe or tubing string, additional pressure may be introduced. At a certain pressure, the pressurized gas will overcome the force of the spring and the ball will be pushed away from the seat.

DETAILED DESCRIPTION OF THE PREFERRED EMBODIMENT

Figure 1:
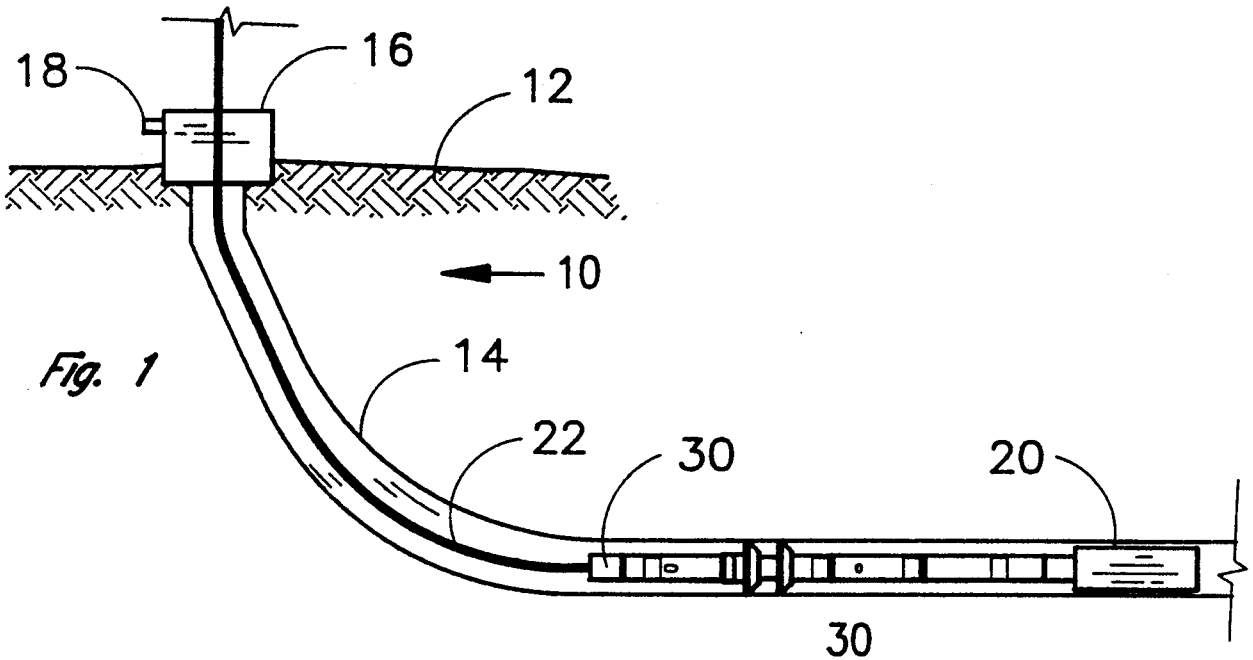
FIG. 1 is a simplified illustration of an underground well shown using the wireline delivery tool of the present invention.

Referring to the drawings in detail, FIG. 1 illustrates a simplified representation of an underground well 10 having a well bore that extends downward from the surface 12 of the earth. FIG. 1 is intended to illustrate a typical oil and gas well used to pump oil or gas from beneath the surface of the earth.

In many instances, the well bore will descend vertically from the earth's surface. The present invention, however, is particularly suited for instances where the well deviates from vertical.

In horizontal drilling, once a prospective drilling area is located, the drilling direction may be changed to a horizontal orientation as readily seen in FIG. 1. This will avoid repeated vertical drilling to reach a desirable location.

A drill pipe or tubing string 14 will be arranged in a well bore and extend the entire length of the well. The drill pipe or tubing string 14 will have a diameter less than the well bore or casing so that a space is formed between the exterior of the drill pipe or tubing string and the well bore or casing. At the surface a well head may include a variety of equipment, including a stuffing box 16 which will create a seal around the otherwise open end of the drill pipe or tubing string 14. Additionally, the valve 18 may be in communication with the stuffing box and in turn the interior of the drill pipe or tubing string 14.

During the drilling operation, at periodic intervals, the drill will be removed from the well. A tool 20 will be lowered into the drill pipe or tubing string. The tool may take the form of a survey tool, logging tool, perforating gun or other well tool. The well tool will be utilized for a number of purposes, such as obtaining accurate information on the well and the formations exposed in the well. Once the mission of the tool is accomplished, the tool will be raised up and removed from the well. The drill can then be reinserted for drilling to continue.

The well tool 20 will be lowered into the well by use of a wireline 22, one end of which begins at the surface 12 of the earth.

In the case of a vertical well, gravity will draw the tool 20 down into the well as the wireline is let out. When the well bore deviates beyond a certain point from vertical, gravity will force the survey tool against the wall of the drill pipe or tubing string and friction will prevent its movement through the drill pipe or tubing string.

In at least one actual situation, it has been found that a well bore that deviates beyond 65° from vertical will prohibit passage of the well tool.

The wireline delivery device 30 of the present invention is seen in FIG. 1 in the well bore juxtaposed between the well tool 20 and the wireline 22. As will be described in detail, gas under pressure will be introduced into the casing through valve 18. The pressure will force the wireline delivery tool 20 through the casing of the well 30.

Figure 2:
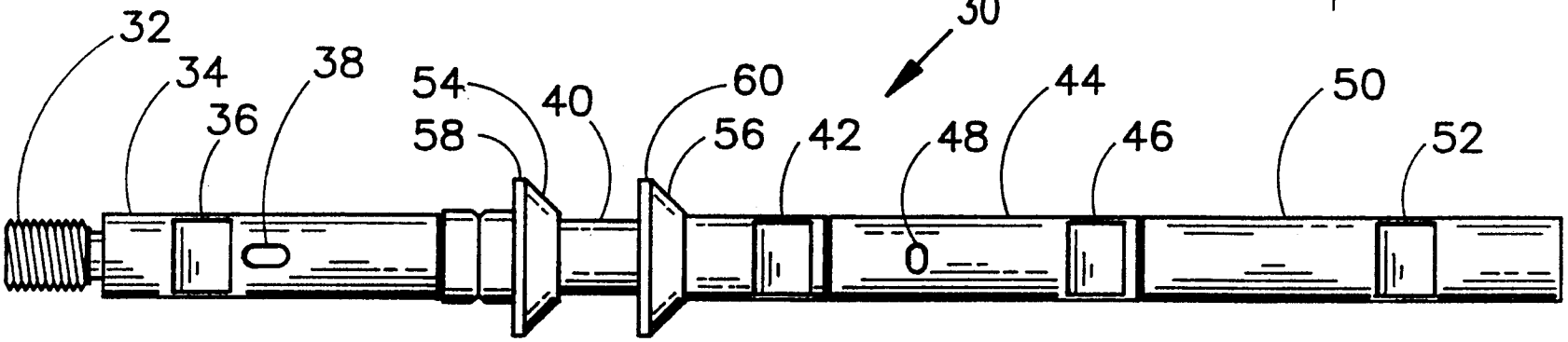
FIG. 2 is a front view of the wireline delivery tool of the present invention.

FIG. 2 shows a front view of the wireline delivery tool 30 apart from the wireline 22 and removed from the well. The wireline delivery device of the present embodiment is substantially cylindrical, although it need not be as long as the diameter of the device is less than the interior diameter of the drill pipe or tubing string 14.

A first end 32 is externally threaded so that it may be attached to a standard rope socket (not shown) which engages the wireline 22. The wireline can thus be quickly engaged or disengaged from the device.

The wireline delivery tool 30 includes a number of sections connected end-to-end.

A tail section 34 terminates in the threaded end 32 and has a substantially cylindrical exterior. At least one wrench flat in the exterior surface facilitates installation and removal of the tail section from the device. The tail section 34 contains an inlet port 38 in communication with an internal bore extending longitudinally therefrom into the tail section.

The bore continues through the tail section and communicates with a similar bore (not seen in FIG. 2) in a cup section 40. The tail section terminates in an internally threaded opening (not seen in FIG. 2) which connects with an externally threaded opening in the cup section.

The internal bore passes longitudinally through the entire length of the cup section 40. The cup section 40 may also include a wrench flat 42 on the exterior surface to facilitate installation and removal of the cup section from the device.

The cup section 40 terminates in an exteriorly threaded end (not seen in FIG. 2). The exteriorly threaded end of the cup section will be threadably connected to a pressure valve section 44. The pressure valve section 44 may also include a wrench flat 46 on its external surface to facilitate installation and removal.

A portion of the pressure valve section 44 has an internal bore which communicates with the internal bore of the cup section 40. The valve section 44 contains an outlet port 48 so that the bore communicates with the exterior of the device. It will thus be seen that a passageway is formed from the inlet port 38 through the internal bore of the device to the outlet port 44.

The valve section 44 terminates in an externally threaded end (not seen in FIG. 2). The externally threaded end would be threadably connected to a tool connection section 50. The tool connection section 50 would, in turn, have an internally threaded end to receive a well tool such as a survey tool or the like. The tool connection section 50 might also have a wrench flat 52 on its exterior surface.

It will thus be observed that the sections 34, 40, 44, and 50 are aligned in series longitudinally to form the body of the device.

With continuing reference to FIG. 2 and additional reference to FIG. 1, the wireline delivery tool 30 of the present invention, along with the attached tool 20, may be delivered to any place within the drill pipe or tubing string. A removable pair of cups 54 and 56 extend from the external surface of the cup section 40. The external edge of the cups 58 and 60, respectively, will mate with the interior of the drill pipe or tubing string 14 to provide a fluid seal therewith. A pump (not shown) will be connected to the valve 18 at the surface so that pressurized air or other gaseous medium may be pumped down into the drill pipe. A closed area is thus created between stuffing box and the cups 58 and 60. The pressure of the gas within the drill pipe or tubing string will force the wireline delivery tool through the drill pipe or tubing string.

A single cup would suffice if the internal diameter of the tubing string or drill pipe were uniform throughout. In many instances, however, joints or other connections have diameters larger than the tubing string or drill pipe. If a single cup passed to such a location, gas would pass around the cup and the seal would be broken. Use of a pair of cups assures that at least one cup will remain in contact with the drill pipe or tubing string at all times.

Figure 3:
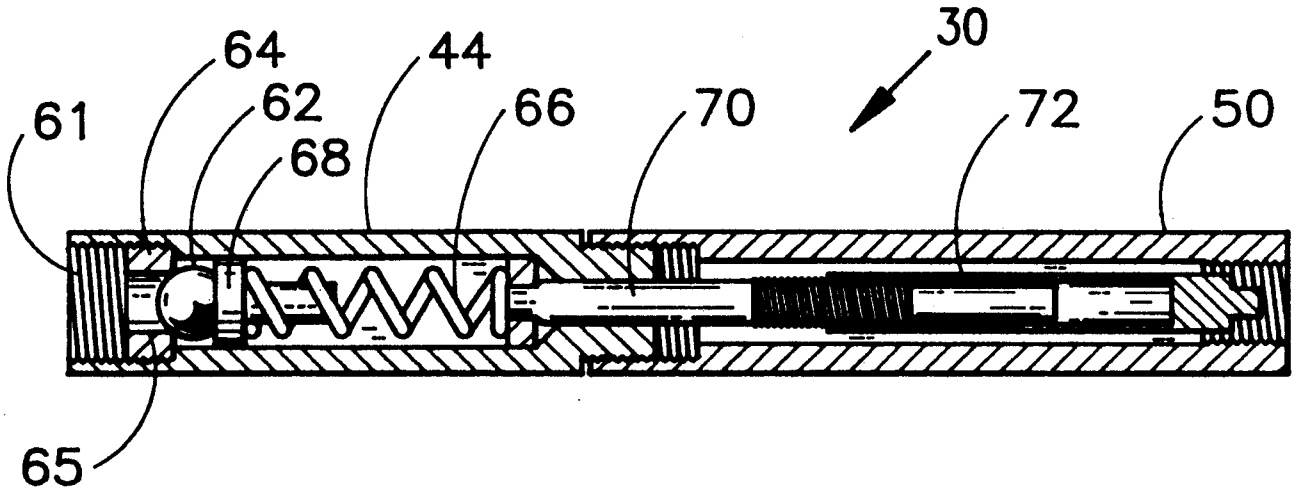
FIG. 3 is a sectional view of a portion of the wireline delivery tool shown in FIG. 2 with the pressure release valve in the normally closed position.
Figure 4:
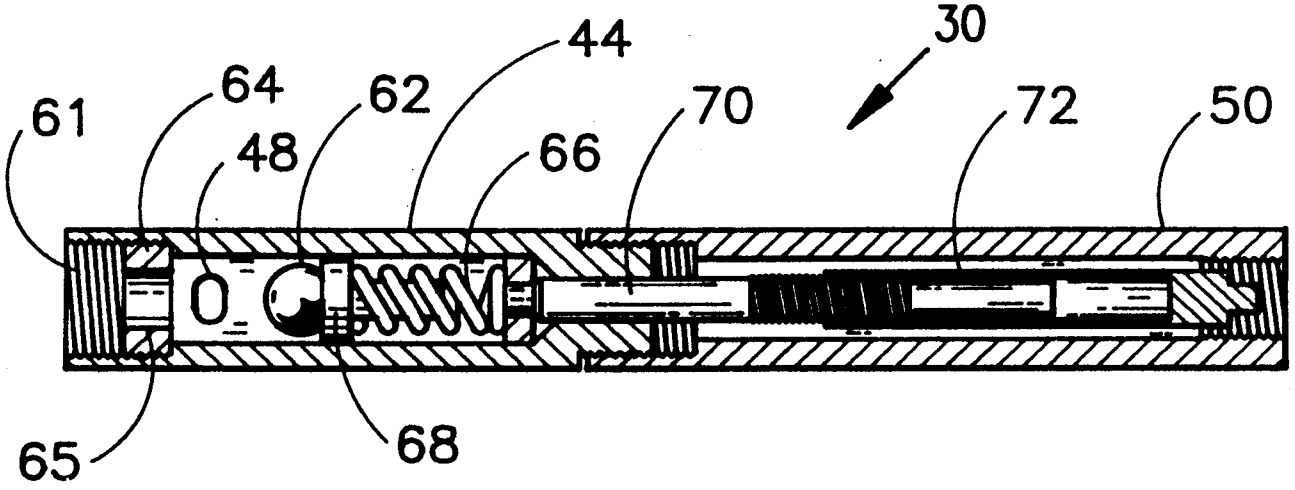
FIG. 4 is a sectional view of a portion of the wireline delivery tool as seen in FIG. 3 with the pressure release valve in the open position.

The wireline delivery tool also has a mechanism for pressure release as is best seen in the sectional views of FIGS. 3 and 4. FIGS. 3 and 4 show a sectional view of the pressure release section 44 and the tool section 50, apart from the balance of the device. As previously described, the threaded end of the cup section 40 will be connected to the internally threaded opening 61 of the pressure release section 44.

FIG. 3 illustrates the normal operating position. A ball 62 will rest in a seat 64 having a passageway 65 through the seat 64. The ball 62 will be urged against the seat by a spring 66 so that a seal is created. The seat may be externally threaded so that it will be threadably received in the internally threaded opening.

When the pump pressurizes the drill pipe or tubing string, inlet port 38 will allow pressurized gas to enter the internal bore so that pressurized gas will enter the passageway 65 of the seat and exert a force on the ball 62. The force of the spring 66 will keep the ball against the seat in the normal operating position. When the pressurized gas overcomes the force of gravity and friction on the device, the device 30 will move further into the well bore.

The amount of force exerted by the spring 66 to keep the ball in the seat 64 is adjustable. One end of the spring terminates in a cup 68 that is affixed to the ball 62. The opposite end of the spring is retained on a post 70 that passes into the tool connection section and is threadably received therein. By rotating the post 70 in the threaded receptacle 72 the length of the spring may be varied, thus varying the pressure on the valve mechanism.

Once the device 30 is at a stopping point, additional pressure may still be applied when the gas pressure overcomes the force of the pressure release valve mechanism, the ball 62 will be pushed away from the seat. Pressurized gas will pass through the seat 64, into the bore of the pressure valve section 44 and out of the outlet port, as seen in FIG. 4. Thereafter, the pressurized gas will circulate past the device and into the space between the drill pipe or tubing string and the well bore or casing.

Whereas, the present invention has been described in relation to the drawings attached hereto, it should be understood that other and further modifications, apart from those shown or suggested herein, may be made within the spirit and scope of this invention.

What is claimed is:

1. A wireline delivery tool for an underground well having a pipe, surface seal means to create a seal in said pipe, and a wireline extending from the surface into the pipe, said wireline delivery tool comprising:

a body having a diameter less than the interior diameter of said pipe;

cup means extending from said body to create a seal with said interior of said pipe said cup means including a pair of spaced apart cups;

a longitudinal bore within said body having a port through said body on each side of said cup means; and pressure valve means within said longitudinal bore to close said bore in the normal operating position, said pressure valve means including a spring forcing a ball against a seat within said bore; and means connected to said body to adjust the pressure required to move said ball away from said seat wherein gas pressure supplied within said pipe between said surface seal means and said cup means will move said delivery tool within said pipe.

2. A wireline delivery tool as set forth in claim 1 wherein said body has two opposed ends, tool attachment means at a first end for attaching a well tool and a wireline attachment means at a second end for attaching said wireline.

3. A wireline delivery tool as set forth in claim 1 wherein said means to adjust the pressure required to move said ball away from said seat includes a threaded post engaged with said spring wherein rotation of the post will vary the length of the spring and thereby vary the pressure.

4. A wireline delivery tool for an underground well having a pipe, surface seal means to create a seal in said pipe, and a wireline extending from the surface into the pipe, said wireline delivery tool comprising:

a body having a diameter less than the interior diameter of said pipe;

cup means extending from said body to create a seal with said interior of said pipe said cup means including a pair of spaced apart cups;

a longitudinal bore within said body having a port through said body on each side of said cup means; and pressure valve means within said longitudinal bore to close said bore in the normal operating position, and open said bore above a preset pressure, said pressure valve means including a spring forcing a ball against a seat within said bore; and means connected to said body to adjust said preset pressure; and means to increase gas pressure within said pipe between said surface seal means and said cup means above said preset pressure to allow gas to circulate through said bore.

* * * * *